United States Patent [19]

Von Rosenberg, Jr. et al.

[11] 4,278,446

[45] Jul. 14, 1981

[54] VERY-HIGH-VELOCITY ENTRAINED-BED GASIFICATION OF COAL

[75] Inventors: Charles W. Von Rosenberg, Jr., Belmont; David B. Stickler, Carlisle; Richard E. Gannon, Andover, all of Mass.

[73] Assignee: Avco Everett Research Laboratory, Inc., Everett, Mass.

[21] Appl. No.: 44,354

[22] Filed: May 31, 1979

[51] Int. Cl.[3] ..... C10J 3/46

[52] U.S. Cl. ..... 48/197 R; 48/202; 48/206; 48/DIG. 4; 252/373

[58] Field of Search ..... 48/197 R, 202, 203, 48/206, 210, DIG. 4, 211, 213, 214 R, 191 R; 252/373; 201/38; 208/130; 423/415 A

[56] References Cited

U.S. PATENT DOCUMENTS

| | | | |
|---|---|---|---|
| 2,621,117 | 12/1952 | Garrison | 48/DIG. 4 |
| 2,767,233 | 10/1956 | Mullen et al. | 48/196 R |
| 2,777,813 | 1/1957 | Totzek . | |
| 2,905,731 | 9/1959 | Seed | 48/213 |
| 2,908,733 | 10/1959 | Sage | 423/415 A |
| 3,242,224 | 3/1966 | Howard . | |
| 3,746,522 | 7/1973 | Donath | 48/202 |
| 3,782,913 | 1/1974 | Donath | 48/202 |
| 3,840,354 | 10/1974 | Donath | 48/202 |
| 3,844,733 | 10/1974 | Donath | 48/202 |
| 3,988,123 | 10/1976 | Coates | 48/73 |
| 4,013,428 | 3/1977 | Babbitt | 48/202 |
| 4,136,015 | 1/1979 | Kamm et al. | 208/130 |

OTHER PUBLICATIONS

Coal Gasification, Massey (Editor) ACS Advances in Chem. Series 131, 1974, pp. 1, 3, 92, 93, 106, 107, 126–129.

Coal Gasification in Steam at Very High Temperatures, Northam et al., Fuel, 1979 vol. 58, pp. 264–268.

Shock Waves in a Dusty Gas, Carrier, Journal of Fluid Mech., vol. 4, part 4 8, 1958, pp 376–382.

Rapid Devolatilization of Pulverized Coal in Hot Combustion Gases, Ubhayakar et al., 16th Combustion Symposium, M.I.T., Aug. 1976.

"Gas Generator Research and Development Survey and Evaluation", Office of Coal Research 1965.

"An Evaluation of the BCR Bi—Gas SNG Process", Hegarty et al., Chem. Eng. Prog., vol 69, No. 3, Mar. 1973.

"Pulverized-Coal Gasification, Ruhrgas Processes", Traenckner, Trans. A.S.M.E., Aug. 1975, pp. 1095–1101.

"Modelling of Entrained-Bed Pulverized Coal Gasifiers", Fuel, vol. 56, pp. 281–291, Jul. 1977.

*Primary Examiner*—Peter F. Kratz

*Attorney, Agent, or Firm*—M. E. Frederick

[57] ABSTRACT

A process and apparatus for gasification of carbonaceous matter, preferably coal, is disclosed. A stream of previously produced char, preferably produced from coal, or other fuel together with an oxidizer and steam is introduced into a first or combustion stage. The combustion gas produced by the combustion passes into a second or gasification stage and through a nozzle at at least sonic velocity. Pulverized carbonaceous matter, preferably coal, is introduced and dispersed in the combustion gas in the gasification stage. The temperature, velocity and velocity changes principally of the gas in the gasification stage are controlled to provide a heating rate for the particles of pulverized carbonaceous matter of at least about $10^5$ degrees Kelvin per second, and to effect rapid removal of volatile components from the immediate vicinity of the particles. Upon substantial gasification of the particles in the gasification stage, the resultant product stream may be quenched, the char removed, and preferably at least a portion thereof introduced into the combustion stage.

13 Claims, 4 Drawing Figures

VERY-HIGH-VELOCITY ENTRAINED-BED GASIFICATION OF COAL

REFERENCE TO RELATED APPLICATION

This application is related to a co-pending application by David B. Stickler, Charles W. von Rosenberg, Jr. and Richard E. Gannon entitled "Subsonic-Velocity Entrained-Bed Gasification of Coal", Ser. No. 044,020 filed May 31, 1979, and assigned to the same Assignee as this application.

BACKGROUND OF THE INVENTION

Field of the Invention

This invention relates to gasification of carbonaceous material, and more particularly to a two stage entrained-bed gasification process and apparatus therefor for gasifying coal.

Treatment of carbonaceous material such as, for example, coal with heat and pressure in order to drive off the volatile components and provide solid, liquid and gaseous products for fuels and chemicals, has been carried out by several processes for over a century.

This technology was used as early as 1807 when town gas produced from coal lit a public street in London. By the turn of the century, German chemists were making a number of products from coal. A large part of the WW II German war machine was fueled by gasoline made from coal. Low Btu gas from coal was also widely used in the United States before the advent of cheap natural gas and oil. Cheap gas and oil pushed coal gasification technology aside, and it did not undergo any major technological advancements until it reemerged recently because of, among other things, substantial increases in the cost of natural gas.

The gasifier or reactor is the heart of a coal gasification process and there are four main types of gasifiers, all of which rely upon external sources of heat or the burning of part of the coal to provide the heat needed to effect gasification.

One well-known type of gasifier, of which the Lurgi device is typical, is the fixed-bed gasifier. In this type of gasifier, sized coal is supplied to the top of the gasifier and the gasifying medium such as oxygen and steam is injected at the bottom. Such gasifiers utilize the lowest operating temperatures and require long residence times of up to 1 hour. Due to the low temperatures used, large amounts of heavy liquids are produced. Ash is removed from the bottom of the gasifier as dry ash or slag depending on the operating temperature. For slagging operation, the gasifier is run at comparatively higher temperatures thus requiring more oxygen and less steam, but providing a faster reaction rate than for the non-slagging mode of operation.

Inherent advantages of a fixed-bed process are high thermal efficiency and carbon conversion and low contamination of gas with solids. Among the disadvantages are that caking coals cannot be used without pretreatment. The coal must have uniform size and good mechanical strength. Production of heavy hydrocarbons is undesirable if the gas produced is to be used as synthesis gas or to produce high Btu gas.

A second type of gasifier is the fluidized-bed gasifier which operates with crushed or fine coal. The fluidized-bed gasifier as compared to the fixed-bed gasifier allows improved gas-solid mixing, uniform temperature distribution and improved gas-solid contact. Fluidized-bed gasifiers can tolerate variations in coal feed during operation, have high gasification rates per unit cross-sectional area and can operate over a large range of output without significant loss in efficiency. Fluidized-bed gasifiers in general require pretreatment of caking coals and longer residence times when compared with entrained-bed gasifiers discussed below. Temperatures are lower than entrained-bed gasifiers, but higher than fixed-beds. Exit gases generally have high dust loading and the range of operating conditions is limited because of fluidization characteristics of particles and danger of entrainment.

A third type of gasifier is the molten bath (salt or iron) gasifier wherein coal is fed with oxygen and steam into a molten bath. Ash and other impurities float to the top as slag and are removed.

The fourth type of gasifier is the entrained-bed which may be divided into single stage and two stage types.

The single stage type is sometimes referred to as the partial oxidation gasifier. In this type, pulverized coal and the gasifying medium, typically oxygen and steam, are fed cocurrently and the coal is gasified in more or less suspension. The exit gas has little or no tars or methane because at the high temperatures used the homogeneous gas-phase reactions proceed to thermodynamic equilibrium. To run the gasifier at high temperatures, larger amounts of oxygen are required compared to fluidized or fixed-bed types. The exit gases have high temperatures and high loading of ash particles. Overall fuel-gas production rates per unit volume of gasifier space are higher than in fluidized or fixed-bed types because of both high reaction temperatures and large particle surface area.

The two stage entrained-bed gasifier, developed at Bituminous Coal Research, Inc., Pittsburgh, PA in the 1960's has perhaps the greatest potential for development of known gasification processes. The present invention is an improvement of the two stage entrained-bed gasifier.

In the two stage type, pulverized coal is introduced into a second or gasifier stage to produce a process gas and a process char. This process char is separated from the process gas and recycled and reacted with oxygen and steam in a first or combustion stage to produce hot combustion gas. As used herein "combustion gas" includes predominantly carbon dioxide and water vapor with lesser amounts of hydrogen and carbon monoxide. The hot combustion gas from the combustion stage is introduced into the aforementioned second stage and contacts the pulverized coal introduced into the second stage. Here the coal is heated and reacted in contact with the combustion gas and steam to produce synthesis gas, some methane, and process char. This gasification reaction is carried out typically at low gas flow velocities of the order of 2–12 feet per second, pressures of about 60 atmospheres and temperatures of about 1200° K.

The pressure and temperature of the combustion gas produced in the first stage are such that in the second or gasifier stage, the classic heterogeneous carbon/steam and carbon/carbon dioxide reactions take place to produce CO and $H_2$.

Upon issuing from the second stage, the exiting gases and entrained char are passed into a quenching zone to cool the gas and char to below the reaction temperature. Thereafter, the quenched process stream is separated into its gaseous and char components.

This process and apparatus have the ability to produce a tar-free, low-sulfur content char product in addition to a gaseous product. For a more complete discussion of the two stage entrained-bed gasifier, reference is made to Department of Interior, Office of Coal Research publication, dated 1965 and entitled "Gas Generator-Research and Development Survey and Evaluation" prepared by Bituminous Coal Research, Inc.; "An Evaluation of the BCR Bi-Gas SNG Process", W. P. Hegarty et al, Chemical Engineering Progress, Vol. 69, No. 3, March 1973; U.S. Pat. No. 3,746,522, issued July 17, 1973; U.S. Pat. No. 3,782,913 issued Jan. 1, 1974; U.S. Pat. No. 3,840,354 issued Oct. 8, 1974; and U.S. Pat. No. 3,844,733 issued Oct. 29, 1974, all of which are incorporated herein as if set out at length.

It has become known in recent years, from the data of experiments performed by ourselves and others, that if coal particles are subjected to very high heating rates, of the order of $10^{5}$° K./sec and higher, a much larger fraction of the coal mass may be devolatilized than the so-called "volatile matter" content of the coal as defined by ASTM Proximate Analysis. In view of the rapidly-changing and somewhat inhomogeneous conditions in such experiments, it is customary to express properties such as velocity, temperature and heating rates in terms of suitable spatial or temporal averages. The cited very high heating rate of $10^{5}$° K./sec or higher is such an average over the brief period of devolatilization.

The value of heating rates on the order of $10^{5}$ °K./sec and higher has been documented in reports of laboratory experiments, viz:

(1) Kimber, G. M. and Gray, M. D., "Combustion and Flame", 11, 360, (1967).

(2) Ubhayakar, S. K., Stickler, D. B, von Rosenberg, C. W., Jr., and Gannon, R. E., "Rapid Devolatilization of Pulverized Coal in Hot Combustion Gases", 16th Symposium (International) on Combustion, 427 (1976).

When done under well-mixed conditions with high temperatures ($T \geqq 1400$° K.), such large heating rates were shown to lead to larger yields of volatiles than conditions with slower heating rates. However, a potential benefit resulting from such heating rates, recognized by us and enjoyed by our invention is a reduction, or even elimination, of the requirement for heterogeneous gasification reactions, which are slow and inefficient. Consequently, use of high heating rates can lead to smaller amounts of oxygen consumption for the total process.

It must be pointed out that the above-noted data were obtained under laboratory conditions, using means or methods not practical for commercial gasification. Existing two-stage gasifiers have residence times which are at least two orders of magnitude larger than those required for operating with the higher degree of devolatilization. We perceive that the reason for this is as follows: a coal particle must be very small if it is to be heated rapidly, even in a very high temperature gas. But heretofore such small particles were permitted to mix slowly with respect to the entraining hot gas, so that heat is brought to them relatively slowly. Such heating is "mixing limited". Heating under "mixing limited" conditions occurs when the characteristic mixing time is greater than the characteristic time for diffusive heat flow to the coal particles and for thermal diffusion within the particles. Similarly, any volatiles arising from such a particle were also permitted to tend to remain near the particle, and to degrade to soot rather than reacting with the surrounding gas to form stable hydrocarbons. Such stabilization is also mixing limited. And the final attainment of equilibrium of the heterogeneous reaction between coal and soot particles and the surrounding gas is also mixing limited. As a result, the present state of the art in two-stage entrained-bed gasifiers is such that the heating rate of the carbonaceous matter particles and the residence times for reactants in the gasification stage are mixing limited. For one example, the gasifier described in the aforementioned Donath U.S. Pat. No. 3,782,913 depends on high pressure, residence times of 5 to 15 seconds and equilibrium chemistry to yield product gas containing essentially the equilibrium amount of methane.

In one set of our experiments, for example, coal was subjected to steam at 1370° K. and 10 atm pressure for reaction times of 50 milliseconds and generated methane in excess of that expected based on equilibrium calculations. Further data obtained by us have shown that under conditions of rapid heating to temperatures of 1370° K. and higher, of finely pulverized coal well-dispersed in a background of steam, followed by rapid cooling, one can obtain methane concentration in the product gas which is substantially larger than would be predicted by equilibrium considerations for the experimental reactor conditions. The detailed reaction chain leading to this is not known, but it is well-known that to attain an equilibrium composition in any chemical reactor requires adequate time. The experimental conditions provided initial temperatures and reaction times which were sufficient for pyrolyzing large amounts of mass from the coal, but at later stages, the temperature-time history was inadequate for attaining equilibrium among the gas phase constituents.

We believe this enhanced volatilization present in accordance with our invention is attained through a nonequilibrium rapid direct pyrolysis pathway, rather than through the usual prior art heterogeneous reaction process. Our invention is thought to give hydrocarbon radicals which react homogeneously with background gas to yield a nonequilibrium product distribution which can be retained by sufficiently prompt cooling. Whatever the reason may be, it is clear that extremely rapid heating of coal particles yields copious amounts of volatiles. This is preferably done in the presence of gases which react with and stabilize the volatiles to prevent formation of soot, and with sufficiently prompt cooling to prevent shift of the composition to equilibrium values.

SUMMARY OF THE INVENTION

It is therefor the general object of this invention to provide a process and apparatus for practical gasification of carbonaceous matter, utilizing a very high heating rate of that matter to achieve a greater yield of gas. It is a particular object of this invention to provide a process and apparatus which are not mixing limited in heating rate of the carbonaceous matter or in stabilization of volatiles arising from such matter.

According to this invention, these objects are achieved by fluid-dynamic provisions which preferably strongly move small particles of the carbonaceous matter in the gasification stage with respect to their surrounding gas, thus obtaining high physical transport interaction between the particles and the gas. In general, this transport interaction is achieved by forcing a velocity differential between the gas and the particles, using the inertia of the particles and one or more strong accelerations and decelerations of the gas. In particular, in this invention, such accelerations and decelerations are provided by introducing and dispersing the particles of carbonaceous matter into a high-velocity flow of hot gas in a deLaval nozzle, passing the resultant supersonic mixed flow through a supersonic diffuser wherein successive shock waves and expansions sharply decelerate and accelerate the gas, and thence into a subsonic diffuser wherein turbulent mixing and composition stabilization occur.

It is to be understood that the present invention may be used with first-stage combustion fuels other than char produced from the gasification of coal, as well as with carbonaceous matter other than coal in the second or gasification stage. For one example, the present invention may be employed to gasify any solid carbonaceous material which can be comminuted, such as sawdust, wood wastes, peat or agricultural waste. For another example, the present invention can be employed to gasify liquid carbonaceous material which can be atomized, such as petroleum products in crude, refined or residual form, crude molasses or spent solvents. For purposes of convenience, the present invention will be described in connection with the use of char and coal. It is to be further understood that part of the first stage heat may be obtained through preheat of the fuel, steam or oxidizer.

This invention provides an improved two stage gasification process and apparatus wherein a char and a product gas including methane comprise the principal products. In the first or combustion stage, char is reacted with oxygen and steam at high temperature and elevated pressure to produce products of combustion including combustion gas comprising principally water vapor and carbon dioxide with a lesser amount of hydrogen and carbon monoxide. The combustion gas is introduced into the second or gasification stage where it is passed through a deLaval nozzle at at least sonic velocity or higher, through a supersonic diffuser in which it is sharply decelerated and accelerated through one or more shock waves and expansions, and then through a subsonic diffuser in which it is slowed.

Pulverized coal together with carrier gas as necessary, is introduced and dispersed into the gas flowing in the nozzle region of the second stage where its interaction with the high-velocity, high temperature, turbulent flow conditions, and with the immediately subsequent sharp changes of gas velocity in the supersonic diffuser, provide rapid mixing of the coal with the combustion gas, rapid movement of the coal particles with respect to the gas, and high heating rates with consequent maximum coal conversion to volatile components through rapid pyrolysis. The rapid mixing and movement also promote stabilizing reactions between the volatile components and combustion gas, thus minimizing soot formation. Further, the rapid flow has as a consequence very high throughput.

The resulting product stream may be quenched and entrained char separated and supplied to the first stage. The gaseous product from the second stage may be used as a basis for gas to be used in various chemical processes, as a fuel gas or as pipe line gas. For the purpose of producing fuel gas, the gaseous product may be passed through a water gas shift reaction stage, cooled and any undesirable remaining constituents such as, for example, sulfur compounds removed.

This invention therefore provides an improved two stage entrained-bed gasification process and apparatus therefor.

The invention further provides an improved two stage entrained-bed gasification process and apparatus therefor having a higher throughput of carbonaceous matter processed under conditions leading to higher yields of volatile matter from the carbonaceous matter than heretofore attainable.

The invention is not mixing limited to the extent of the prior art and as a result, permits up to two orders of magnitude or more increase in heating rate. This, in turn, leads to substantial improvement in utilization of the devolatilization reaction and concomitant reduction in the demands on the slower, less efficient char/steam and char/$CO_2$ heterogeneous reactions. This, in turn, leads to a larger yield of product gas for a given amount of oxygen consumption than heretofore. This invention also permits up to two orders of magnitude decrease in reaction residence time with concomitant very high throughput.

In addition, the invention allows for the production of larger than equilibrium amounts of methane. This is possible by virtue of the predominant chemical route being pyrolysis of the carbonaceous matter in the gasification stage followed by homogeneous gas phase stabilization reactions, under conditions of rapid heating followed by sufficiently prompt cooling.

Thus, the present invention utilizes the chemical composition of the pyrolysis products to yield greater than equilibrium amounts of methane, directly and as a result of the reaction of those pyrolysis products with the surrounding gas.

The invention provides further improved performance since it produces higher interaction of nascent volatile matter with the background combustion gas which leads to increased amounts of homogeneous gas phase reactions which, in turn, leads to stable synthesis gas and product gas rather than soot.

The invention by utilization of at least sonic, turbulent flow at high temperature achieves very high rates of heating and mixing. And, by passing the mixed flow through one or more shock waves and expansions, the invention achieves continued very high rates of heating and mixing.

DESCRIPTION OF THE PREFERRED EMBODIMENT

Figure 1:
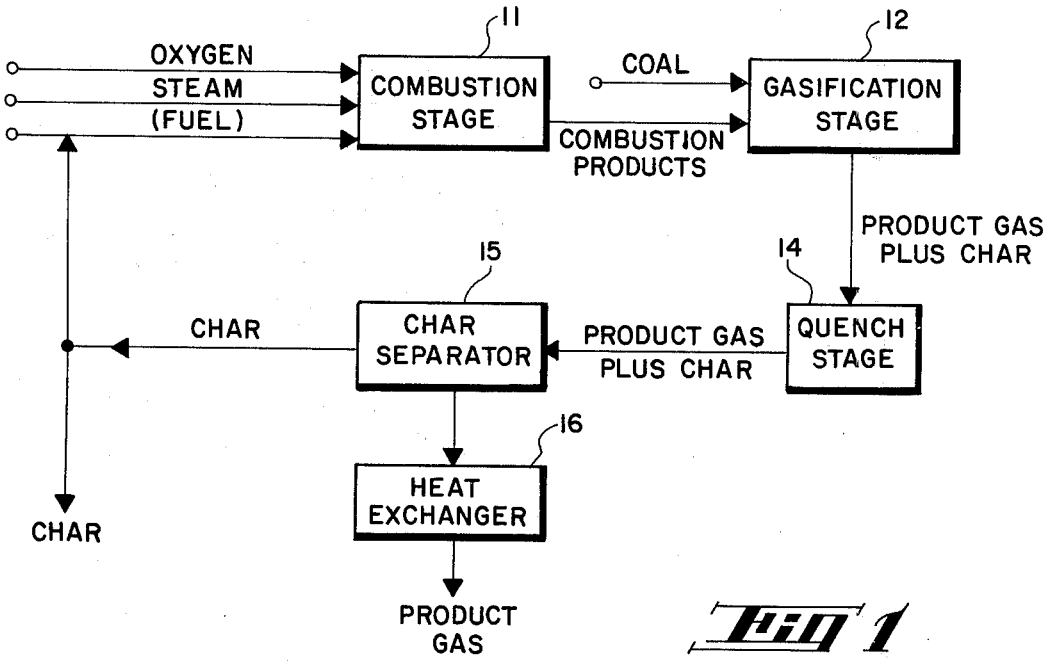
FIG. 1 is a block diagram of apparatus for carrying out a process according to the invention.

Referring now to FIG. 1 which illustrates the process of the present invention, pulverized fuel, oxidizer and steam are introduced as shown to the combustion stage 11. The fuel may include coal or the like, but preferably is char separated from the product stream, the oxidizer is preferably oxygen and the steam is preferably superheated steam.

The combustion stage 11 may be of conventional design for operation at high or relatively high temperatures coupled to the gasification stage 12 having a deLaval nozzle 13 more fully described in connection with FIGS. 2, 3 and 4. The fuel and the oxidizer are combusted in the combustion stage 11 to produce products of combustion including combustion gas and to superheat the steam mixed therein to the high exit temperature of the gases of the combustion stage. In the combustion stage, the reaction of char, oxygen and steam is exothermic and in accordance with the invention, provides a temperature of about 1900° to 2500° K., depending on the type and quantity of fuel and oxidizer used and the temperature and volume of steam. The char is substantially completely gasified and the combustion gas issuing from the combustion stage comprises principally water vapor and carbon dioxide with lesser amounts of hydrogen and carbon monoxide. The combustion stage may also be provided with slag removal means to remove excess slag.

The combustion gas including the steam plus any residual char or mineral matter is passed through a nozzle 13 (see FIG. 2) in the gasification stage 12 into which pulverized coal is simultaneously introduced and dispersed. In the gasification stage 12, a reaction takes place to produce a product gas comprising CO and $H_2$ and $CH_4$, with a minimal amount of $CO_2$ and $H_2O$.

Upon completion of the reaction in the gasification stage 12 if cooling of the gas is required, the product gas may be introduced into the quench stage 14. The quench stage may include a zone of injection of cold fluid such as water or may comprise a heat exchanger. The cooled product stream including char is then introduced into the char separator 15 such as, for example, a conventional cyclone separator. If desired, the quench stage may be included in the char separator. In the cyclone separator, product gas is continuously withdrawn in a conventional manner and supplied to, for example, a heat exchanger 16 for extracting useful heat and for cooling the product gas, and shift conversion means (not shown) for further processing. The separated char is separately withdrawn in conventional manner and at least a portion supplied to the combustion stage 11 as fuel. Where there is excess char, the balance may be withdrawn and used for power plant fuel or the like.

Upon separation, the char may, if desired, be collected in char hoppers (see FIG. 2) operating as lock hoppers in a switching cycle to transfer char from the cyclone separator to the char hoppers which operate at high pressures. From the char hoppers, the char may be metered into the combustion stage in a suitable carrier gas such as product gas.

The char may be metered by means such as starwheel feeders (not shown) and entrained into the combustion stage.

Finely pulverized coal may be metered from piston feeders or coal feed hoppers by a starwheel feeder (not shown) into a pressurized carrier fluid such as, for example, product gas or steam and carried to the gasification stage 12 as a pressurized dense fluidized phase.

In the combustion stage 11, if loss of steam feed occurs, temperatures could approach unsafe values unless the process is immediately shut down. Accordingly, careful installation and start-up and shut-down procedures suitable to provide the desired level of protection are recommended.

In the combustion stage, the reaction of char, oxygen and steam is exothermic and in accordance with the invention, provides a temperature of about 1900° to 2500° K. The char is substantially completely gasified and the products of combustion issuing from the combustion stage comprise principally water vapor (the steam) and carbon dioxide with lesser amounts of hydrogen and carbon monoxide. The combustion stage may also be provided with slag removal means (see FIG. 2) to remove excess slag from the combustion stage. Upon introduction into the gasification stage and contacting the pulverized coal in the manner more fully described hereinbelow, the coal is rapidly heated and reacts with the combustion gas and steam to produce synthesis gas, methane and char.

Figure 2:
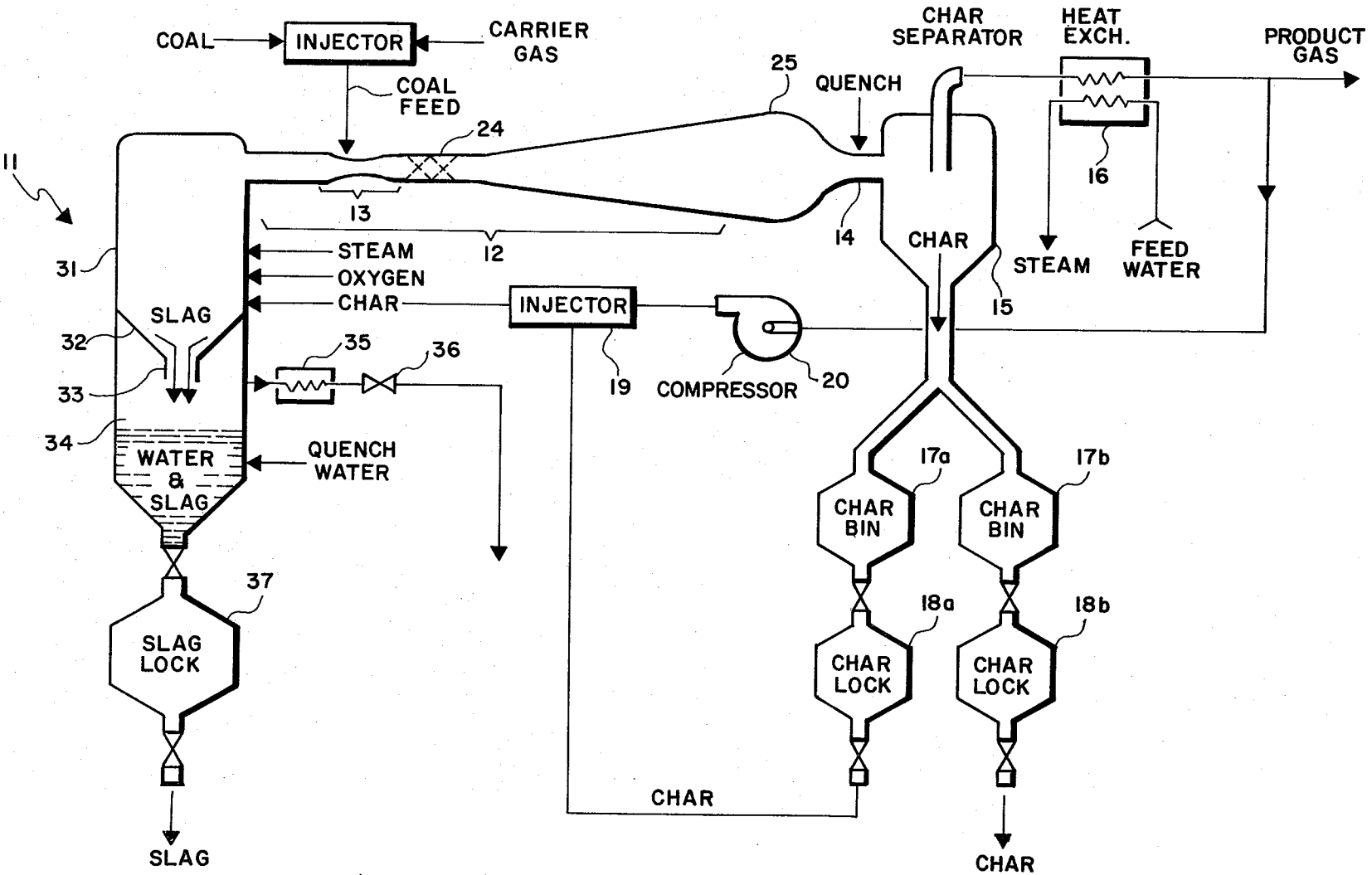
FIG. 2 is a diagrammatic representation in cross section of apparatus in accordance with the invention.

Directing attention now to FIG. 2, there is shown, in diagrammatic form, a combustion stage and a gasification stage combined in accordance with the present invention, together with the principal associated and auxiliary components required for a gasification apparatus.

Combustion stage 11 comprises a combustion vessel 31 into which char, superheated steam and oxygen are introduced and react to provide products of combustion including combustion gas at a pressure of about 2–100 atmospheres, with a preferred range of about 10–15 atmospheres, and a temperature of about 1900° to 2500° K. The combustion gas comprises principally $CO_2$ and $H_2O$ with a lesser amount of CO and $H_2$. The walls of combustion vessel 31 are preferably water-cooled and become coated with a layer of solidified slag, over the surface of which molten slag, derived from the mineral content of the char, flows downward to frusto-conical vessel bottom 32. Thence, the slag may flow through slag taphole 33, whence it may fall into quench water in slag receiver 34 and be solidified as broken particles of slag. In order to prevent freeze-up of slag in taphole 33, a very small flow of hot combustion gas may be passed downward through the taphole and into receiver 34, and thence through cooler 35 and throttle valve 36. The heat extracted in cooler 35 may be utilized to heat feed water, and the combustion gas throttled through valve 36 may be discarded or employed elsewhere in the process. Solidified slag particles may be removed from receiver 34 through slag lock 37. During startup of the combustion stage, gas fuel may be introduced therein in lieu of char, and steam flow may be decreased or omitted.

Combustion stage 11 provides a flow of hot combustion gas to gasification stage 12, which comprises, successively, a deLaval nozzle 13 through which the flow accelerates from subsonic to supersonic velocity, a supersonic diffuser 24 through which flow decelerates to about sonic velocity through shock and expansion regions, and a subsonic diffuser 25 in which the flow is further slowed with overall recovery of a considerable part of the pressure at the inlet to the gasification stage. Pulverized coal, together with a carrier gas, is introduced, dispersed and mixed in the flow of hot products of combustion in nozzle 13. The details of such introduction, dispersion and mixing, and the process advantages resulting from passing the mixture of coal and gases through the shock and expansion regions in supersonic diffuser 24, will be set forth hereinafter with reference to FIGS. 3 and 4.

The output stream from subsonic diffuser 25, now mainly synthesis gas and methane carrying char particles, may, if desired, be quenched by addition of water or steam in duct 14 which therefore constitutes a quench stage. Such quenching should be to a temperature which is low enough to suppress further chemical reactions in the product stream and to be withstood by the following char separator 15, but still high enough for raising steam in the following heat exchanger 16. Such quenching will not usually be necessary, due to the overall endothermic nature of the pyrolysis and gasification reactions taking place in diffusers 24 and 25. However, as a safety measure, provision should be made for introducing a flow of water into those diffusers in the event of a stoppage of coal flow and in the course of system startup, since then the endothermic reactions would not take place. It is further contemplated that provision may be made for venting flow from the diffuser regions during startup, in order rapidly to establish the necessary pressure ratio across deLaval nozzle 13.

Char particles are removed from the output stream in char separator 15, yielding a clean hot product gas which is cooled in heat exchanger 16, and hot char which is collected in one or more char bins 17*a* and 17*b*. At least a portion of the collected char is withdrawn through a char lock 18*a* and is passed through char injector 19 for introduction into combustion vessel 31. The carrier gas for such injection may advantageously be product gas from the output of heat exchanger 16, pressurized by compressor 20. When there is excess collected char, the balance may be withdrawn through another char lock 18*b*, and used for plant fuel or the like. Steam or natural gas may also be employed as a carrier gas for the injection of char; this may be particularly advantageous during startup of the gasifier, when product gas may be in short supply.

Figure 3:
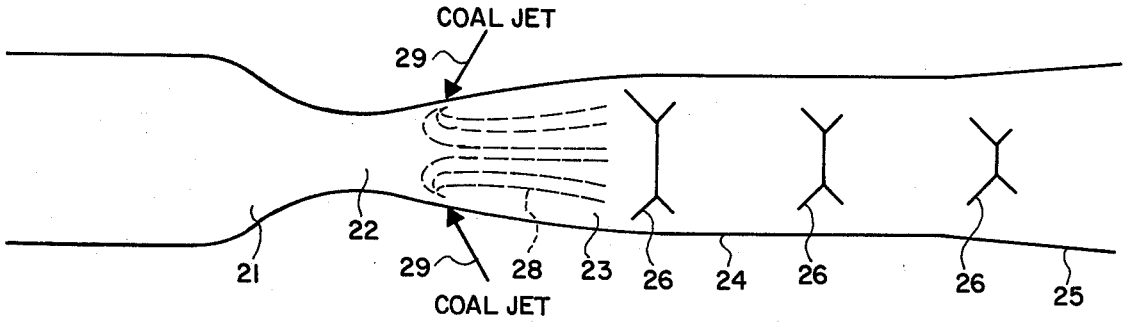
FIG. 3 is an enlarged diagrammatic representation of a portion of the apparatus of FIG. 2, illustrating one embodiment of the invention.

Directing attention now to FIG. 3, there is shown, in enlarged diagrammatic form, that portion of gasification stage 12 comprising deLaval nozzle 13, supersonic diffuser 24 and a portion of subsonic diffuser 25. As shown in the figure, nozzle 13 has a convergent inlet portion 21, a throat 22 and a divergent outlet portion 23. The pressure ratio across the nozzle is sufficient that subsonic flow upstream of the nozzle is accelerated in inlet portion 21 to reach sonic velocity at throat 22, with consequent acceleration to supersonic velocity in outlet portion 23. At the downstream end of the nozzle 13, and connected thereto, is a supersonic diffuser 24, which may be configured as a straight duct. The abrupt change of wall slope, at the junction of divergent nozzle outlet portion 23 and supersonic diffuser 24, gives rise to preferably the first of a series of shock waves 26 separated by intervening expansions. When passing through shock waves 26, the gas flow is abruptly and strongly decelerated and when passing through the intervening expansions, it is accelerated. In consequence, the gas flow is subjected to a series of decelerations and accelerations, with an overall decrease of velocity, from supersonic at the entrance to supersonic diffuser 24, to subsonic at the exit from diffuser 24 and the entrance of subsonic diffuser 25. Alternatively, a duct wall with steps, angle variations and the like suitable for controlling and/or stabilizing shock wave locations may be used.

In this embodiment of the invention, it is contemplated that finely pulverized coal, entrained in a carrier gas, be fed into the high-velocity combustion gas flow at or just downstream of throat 22 of deLaval nozzle 13, where the flow in divergent outlet portion 23 is supersonic and accelerating. The coal feed is preferably in the form of high-velocity jets 29 and should have adequate velocity to penetrate and be dispersed in the supersonic flow as indicated generally by the dotted trajectories 28. In order to obtain the most uniform dispersion of pulverized coal introduced into the high-velocity flow of combustion gas, a plurality of jets may be arranged around nozzle 13.

Upon being introduced into nozzle 13, the coal particles are stripped of their surrounding carrier gas by the supersonic flow of combustion gas. In the supersonic flow, the temperature is depressed below that of the hot gas at the entrance to the nozzle, and the coal particles have an opportunity to disperse and accelerate toward the velocity of the combustion gas before arriving at the first shock 26, where the gas temperature abruptly rises to a peak, and at the same time the gas is abruptly decelerated. The coal particles, due to their inertia, tend to plunge forward through the abruptly decelerated gas. Because of this strong velocity differential, and the concurrent very high temperature, the particles are subjected to an especially high heating rate heretofor unappreciated and unused by the prior art. Also, any volatiles from the resulting pyrolysis are swept away from the particles into the surrounding combustion gas, with which the volatiles may react to form stable gaseous species.

After passing through the first shock wave 26, the coal particles and gas pass through a following first expansion. Here the gas is accelerated and the coal particles, by inertia, drag backward through the accelerating gas. Again, there is high physical transport interaction between particles and gas, with high heating rate and effective stabilization of volatiles from pyrolysis.

The entire process is repeated for any successive shock waves and expansions, so that the coal particles are subjected to a rapid succession of extremely high heating rate events, accompanied by rapid convection and stabilization of volatiles. Thereupon, the coal particles, immersed in a very turbulent flow of still fairly hot combustion gas and gasification product gas, pass through subsonic diffuser 25 wherein the flow is slowed down and the coal particles are finally completely transformed to product gas and char.

In choosing the dimensions for a gasification stage according to this invention, the following considerations are of importance: particles of finely pulverized coal, having diameters, for example, of the order of 10 to 20 micrometers, can have characteristic thermal diffusion times of 0.2 to 0.8 milliseconds, and characteristic heat transfer times from the immediately surrounding gas of about twice those values. In that size regime, where particles do not track gas flow velocity changes exactly, it is calculable that mixing times can dominate the overall heating times. To prevent this, it is desirable to use, for example, a combination of injection jet momentum and turbulent dispersion. Coal injection may be by means of jets with cross section and momentum selected for penetration of the jets into the primary gas flow a distance approaching the local transverse dimension of the flow duct. Multiple jets may be used, originating at various points on the duct wall, and with selected velocity vectors, to give substantially complete and grossly uniform coverage of the hot gas flow with finely divided coal or other carbonaceous matter. Turbulent mixing around the jet perimeters, over their trajectories, results in distribution of this finely divided matter. This distribution attains final homogeneity due to turbulent mixing in the two-phase flow downstream of the coal injection region of the gasifier. For an inhomogeneity scale of initial coal jet input of about one-tenth of the transverse dimension of the gasifier, an axial flow velocity in the gasifier of one meter per millisecond requires a turbulent intensity of only about 1% to achieve mixing in a time scale of about 0.3 to 0.6 milliseconds. This is adequately rapid relative to a particle thermal response time scale in the range 0.6 to 2.4 milliseconds.

In this context of coal input as discrete dense phase jets of particles and carrier gas, it is of importance that the particle begin to undergo substantial heating only when they leave the jet core flow and begin turbulent dispersion, according to transport process similarity. This implies that particle heating starts when it begins to mix with the surrounding hot gas in a turbulent or turbulence dissipation sense, and not when it merely crosses the gasifier boundary as part of a jet. However, extremely strong radiative heat transport, accompanied by long dispersion times, might tend to give premature particle heating.

In the context of a temperature difference of the order of 1500° K., the previously-described rapid and complete dispersion can yield a high heating rate of the order of $10^{6}$° K./sec. And in the same particle heating time scale of 0.6 to 2.4 milliseconds, the particles can travel 0.6 to 2.4 meters at a typical average velocity in the supersonic diffuser. This yields a length dimension of the order of a meter or two for the supersonic diffuser and the immediately contiguous portions of the deLaval nozzle and the subsonic diffuser, for the purpose of providing the desired rapid particle heating.

It has been pointed out by Kimber and Gray that, at heating rates of the order of $10^{5}$° to $10^{6}$° K./sec, substantially complete devolatilization of smaller particles can be performed in 75 milliseconds at 1370° K., and in only 15 milliseconds at 1920° K.; the latter temperature is more typical of the present invention. At an average velocity of 250 meters per second, in the subsonic diffuser, 15 milliseconds requires a path length of about 3.75 meters; a subsonic diffuser length of the order of 4 meters or more would suffice for such conditions. Similar basic physical considerations can be utilized in choosing the dimensions of apparatus for these or other conditions of flow and temperature.

The abruptness of the wall angle between the end of the flaring outlet portion 23 of nozzle 13 and the following supersonic diffuser 24 may be selected to produce proper strength of the first shock wave 26, which arises from the change in flow direction at the angle. If the angle were very abrupt, as for example by use of a steep wall ramp or other constriction, the first of the shock waves 26 would be a strong shock wave which would slow the gas flow to subsonic velocity, and succeeding shock waves 26 would accordingly be either weak or absent depending upon the degree of intervening expansions. While such a strong shock wave would provide a single event of strong physical transport interaction between the coal particles and the surrounding combustion gas, marked by extremely rapid heating of the particles and sweeping away of volatiles, the lack or weakness of similar following events could be disadvantageous. Conversely, a very small wall angle there could result in a weak first shock wave 26 with consequently stronger following shock waves. In such a case the initial physical transport interaction there could be insufficient to initiate prompt rapid heating of the particles and sweeping away of their volatiles.

We, therefore, prefer to employ a moderate value of wall angle at that location, in order to produce a first shock which can slow the gas flow by a useful fraction of the supersonic-sonic velocity difference to provide prompt and high physical transport interaction, while leaving sufficient stagnation pressure in the flow to support following shock waves. Calculations of such flows in detail are very complex, since two reacting phases are present in regions of interest, with consequent effect upon both the gas dynamics and thermodynamics. Fortunately, if supersonic diffuser 24 has a sufficient length-diameter ratio, say ten or more, overall performance is not critically dependent upon exact wall angles, since it is known that the shock wave and expansion wave complex will always adjust itself to provide overall deceleration of gas flow to appropriate velocity and pressure.

A useful engineering approximation to the exact flows can be obtained from simple single-phase ideal gas theory which indicates, for example, that moderate wall angles from 14° to 18°, for initial Mach 2.0 supersonic flows, would provide an oblique shock having downstream flow of Mach 1.5 to 1.3 with recovery to 78% to 83% of the initial temperature. Similar approximate calculations for other initial conditions indicate other useful values of wall angle, generally in the range from 5° to 35° for different choices of flow velocity and of strength and numbers of shock waves. Such calculations can be greatly facilitated by use of published charts such as those in "Elements of Gasdynamics" by H. W. Liepmann and A. Roshko, John Wiley, 1957, on pages 428–431 which is hereby incorporated by reference. Actual coal particle loading and endothermic pyrolysis reactions will result in actual flows and temperatures which depart from the indications of these approximations, but the trends are clear and provide a useful engineering check on parameters chosen through calculations.

Figure 4:
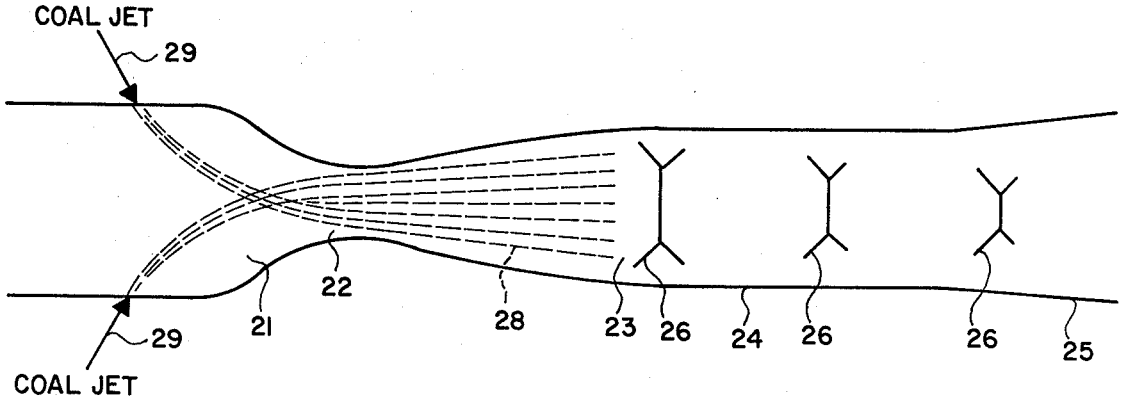
FIG. 4 is a further enlarged diagrammatic illustration, illustrating another and presently preferred embodiment of the invention.

Directing attention now to FIG. 4, there is shown, in enlarged diagrammatic form, the same portion of the gasification stage which was shown in FIG. 3, but with a different location for the introduction and dispersion of the pulverized coal. This is the presently preferred embodiment of the invention. As shown in FIG. 4, the finely pulverized coal, entrained in a carrier gas, is fed as coal jets 29 into the hot high-velocity combustion gas flow in the convergent inlet portion 21 of deLaval nozzle 13. This different location yields some advantages, and also some disadvantages, compared to that illustrated in FIG. 3. Most importantly, it somewhat simplifies the injection of the coal, since jets of lower velocity can achieve penetration into the slower flow of combustion gas. Also, the longer time available for dispersion, before the coal particles reach the first shock wave, allows more even distribution of the coal particles and better stripping of the carrier gas. Also, the accelerated gas flow through the transsonic nozzle functions as described above for expansion wave flow, giving high heating rate of the entrained solids.

There is a further simplification which can be attained by the use of the preferred location of injection: the jets 29 in the configuration of FIG. 3 should be aimed somewhat upstream, to get optimum penetration and adequate dispersion before arrival of the particles at the first shock wave. Such jets can be exposed to erosion by particles of slag or unburned char. But the jets 29 in the preferred configuration of FIG. 4 should be aimed somewhat downstream, in order to bring the particles up to speed quickly, and to reduce residence time in the hot flow in inlet portion 21. Such jets are intrinsically easier to protect from the hot flow. Preferably the jets 29 should be aimed so that the trajectories 28 of coal particles are well centered upon nozzle throat 22. Their radial momentum will then cause them to take divergent paths in outlet portion 23, thus improving dispersion.

It is also possible to select the jet 29 locations and directions in the embodiment of FIG. 4 to give uniform, rapid dispersion of the coal in a high velocity, subsonic gas flow, thereby optimizing the heating effect of the expanding nozzle flow.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims:

We claim:

1. A process for the gasification of solid carbonaceous fuel comprising:

(a) combusting carbonaceous matter and an oxidizer in a combustion stage whereby said carbonaceous matter and oxidizer are reacted and products of combustion including combustion gas are formed;

(b) introducing steam into said combustion stage;

(c) introducing said combustion gas and steam under pressure to a gasification stage having a nozzle through which said combustion gas and steam flow at at least sonic velocity;

(d) introducing and dispersing finely-divided solid carbonaceous fuel comprising particles in said combustion gas at said nozzle;

(e) selectably controlling characteristics of said flow of said combustion gas and steam containing said dispersed solid fuel to provide relative movement of said particles of said fuel with respect to said combustion gas and stream by using the inertia of said particles and a plurality of accelerations and decelerations of said combustion gas and steam, provided by at least one shock wave and expansion in said flow, said combustion gas and steam having an initial temperature and said selected flow characteristics providing sufficient relative movement to provide an average heating rate of said fuel of at least about $10^5$ degrees Kelvin per second whereby said fuel is partially gasified and reduced to char and a product gas is formed;

(f) withdrawing from said gasification stage a product stream comprising said char and product gas;

(g) separating said char from said product stream; and (h) returning at least part of said separated char to said combustion stage to provide carbonaceous matter for combustion.

2. The process as set forth in claim 1 wherein a larger fraction of the fuel is volatilized than the volatile matter content of said fuel as defined by ASTM proximate analysis.

3. The process as set forth in claim 1 wherein said product stream drops in temperature at a rate sufficient to substantially prevent attaining equilibrium among the gas stream constituents.

4. The process as set forth in claim 3 wherein the cooled gas stream contains methane and the methane content of said cooled gas stream is larger than would be predicated by equilibrium considerations.

5. The process as set forth in claim 2 wherein said nozzle has a convergent inlet portion, a throat portion, and a divergent outlet portion; and the velocity of said products of combustion and steam increases concomitant with a decrease in temperature in said nozzle outlet portion.

6. The process as set forth in claim 5 wherein said fuel is introduced at said nozzle inlet portion.

7. The process as set forth in claim 5 wherein said fuel is introduced at said nozzle outlet portion.

8. The process as set forth in claim 1 wherein said carbonaceous matter comprises at least in part said separated char and said char is substantially completely combusted in said combustion zone.

9. The process as set forth in claim 1 wherein said products of combustion and steam are introduced into said gasification zone at a temperature above about 1900° K.

10. The process as set forth in claim 1 wherein said solid carbonaceous fuel is substantially uniformly introduced into said combustion gas and steam at said nozzle and in a direction at least substantially across the direction of flow of said combustion gas and steam through said nozzle.

11. The process as set forth in claim 10 wherein the velocity of said combustion gas and steam is controlled to provide a difference in the velocity of said combustion gas and steam and the velocity of said solid carbonaceous fuel whereby as the particles comprising said solid carbonaceous fuel flow through said gasification stage and are gasified to form said product gas, said combustion gas and steam substantially continuously rapidly carries away from said particles of solid carbonaceous fuel the products of the gasification thereof.

12. The process as set forth in claim 11 wherein a shock wave is caused to occur in said gasification stage downstream of said nozzle after substantially complete mixing of said combustion gas and steam and solid carbonaceous fuel.

13. The process as set forth in claim 12 which includes cooling the product stream withdrawn from said gasification stage to a temperature below that at which steam will substantially react with said product gas, said cooling being at a rate sufficient to substantially prevent the formation of soot in said product stream.

* * * * *

UNITED STATES PATENT AND TRADEMARK OFFICE

CERTIFICATE OF CORRECTION

PATENT NO. : 4,278,446

DATED : July 14, 1981

INVENTOR(S) : Charles W. von Rosenberg, Jr.; David B. Stickler and Richard E. Gannon It is certified that error appears in the above-identified patent and that said Letters Patent are hereby corrected as shown below:

Column 8, line 26, for "10-15", read--10-50--.

Column 13, line 47, for "stream", read--steam--.

Signed and Sealed this

*Twenty-second* Day of *September 1981*

[SEAL]

*Attest:*

GERALD J. MOSSINGHOFF

*Attesting Officer*

*Commissioner of Patents and Trademarks*